US005244240A

United States Patent [19]

Nordmeyer et al.

[11] Patent Number: 5,244,240

[45] Date of Patent: Sep. 14, 1993

[54] Z-BAR SECURITY SYSTEM

[75] Inventors: Robert A. Nordmeyer, Woodland Hills; Alvin S. Levenson, Van Nuys, both of Calif.

[73] Assignee: The Brooke-Duveen Group Ltd., Tarzana, Calif.

[21] Appl. No.: 954,588

[22] Filed: Sep. 30, 1992

[51] Int. Cl.[5] ..... E05C 17/32

[52] U.S. Cl. ..... 292/263

[58] Field of Search ..... 292/273, 274, 270, 202, 292/304, 341.17, 140, 159, 68, 263

[56] References Cited

U.S. PATENT DOCUMENTS

| | | | |
|---|---|---|---|
| 1,029,693 | 6/1912 | Klein | 292/263 |
| 2,205,156 | 6/1940 | Rowley | 292/304 X |
| 2,407,900 | 9/1946 | Paul | 292/263 X |
| 3,873,142 | 3/1975 | Reid | 292/68 X |
| 3,924,885 | 12/1975 | Markovitch | 292/262 |
| 3,924,886 | 12/1975 | Markovitch | 292/263 |
| 3,924,887 | 12/1975 | Markovitch | 292/283 |

*Primary Examiner*—Richard E. Moore

*Attorney, Agent, or Firm*—Poms, Smith, Lande & Rose

[57] ABSTRACT

A system for locking a door can: (1) lock the door in dead bolt fashion, (2) allow the door to open a limited distance, or (3) allow the door to open freely. The system has a door-mounted latch assembly that includes a base plate, an intermediate link pivoted to the base plate, and a mode selection and latching assembly that is pivoted to the intermediate link. The latch assembly also includes a high strength, "T"-shaped latch member, and camming means to slide the latch member back and forth as a control knob is rotated. A latch plate is mounted on the door frame in juxtaposition to the door-mounted latch assembly. The latch plate has a cylindrical portion with a vertical slot for receiving the "T"-shaped latch member. A cylindrical sleeve fits inside the cylindrical portion of the latch plate. Like the cylindrical portion of the latch plate, the sleeve has a vertical slot for receiving the latch member. The sleeve also has a horizontal slot running perpendicular to and intersecting with the vertical slot. When the latch member is engaged in the cylindrical portion of the latch plate, the cylindrical sleeve can be rotated so that the latch member is engaged with the horizontal slot in the cylindrical sleeve. The latch member then cannot be directly withdrawn from the latch plate.

21 Claims, 4 Drawing Sheets

FIG. 1
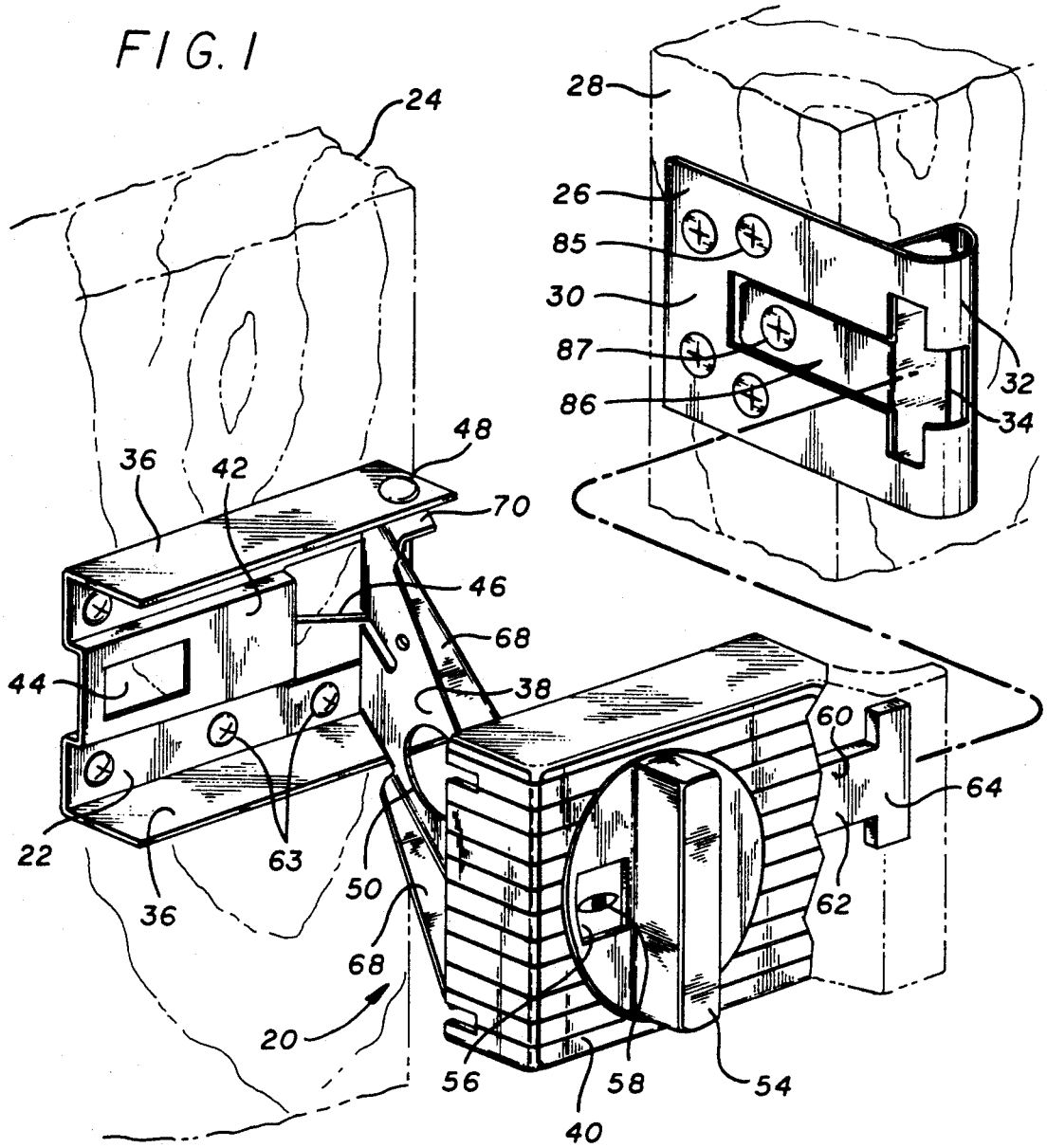
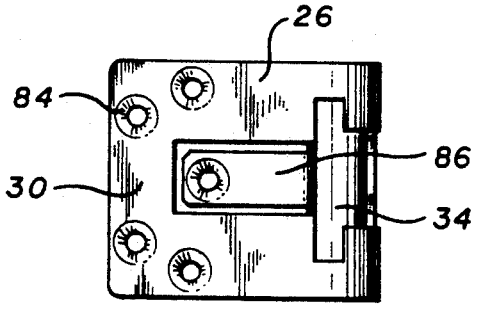
FIG. 2
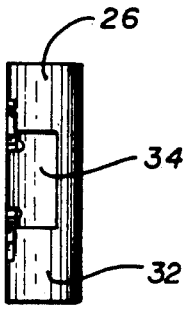
FIG. 3

FIG. 7
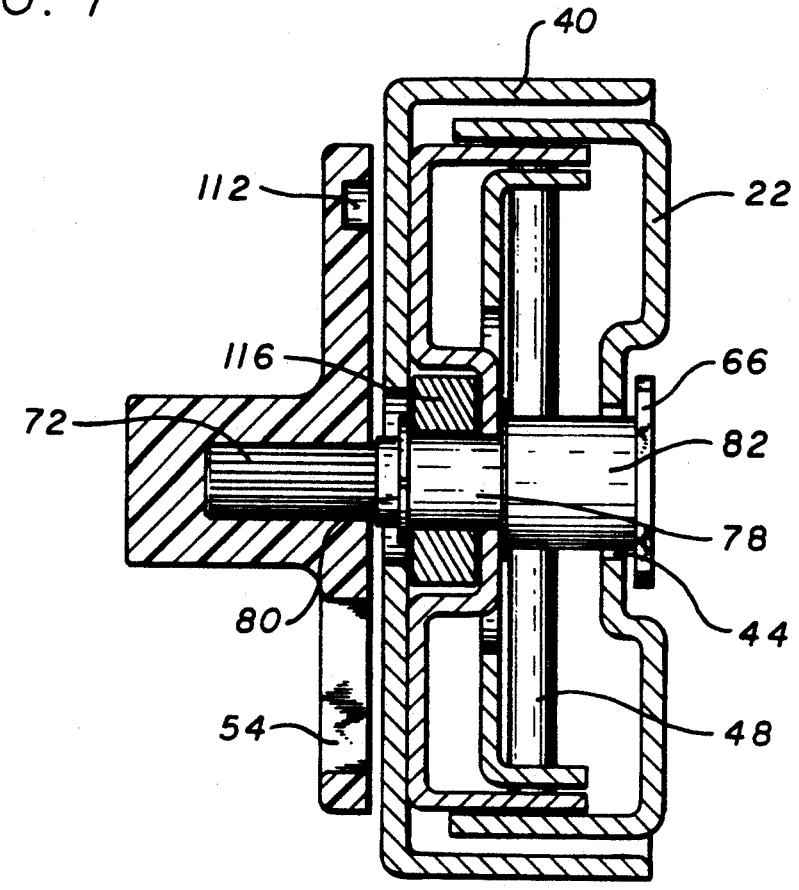
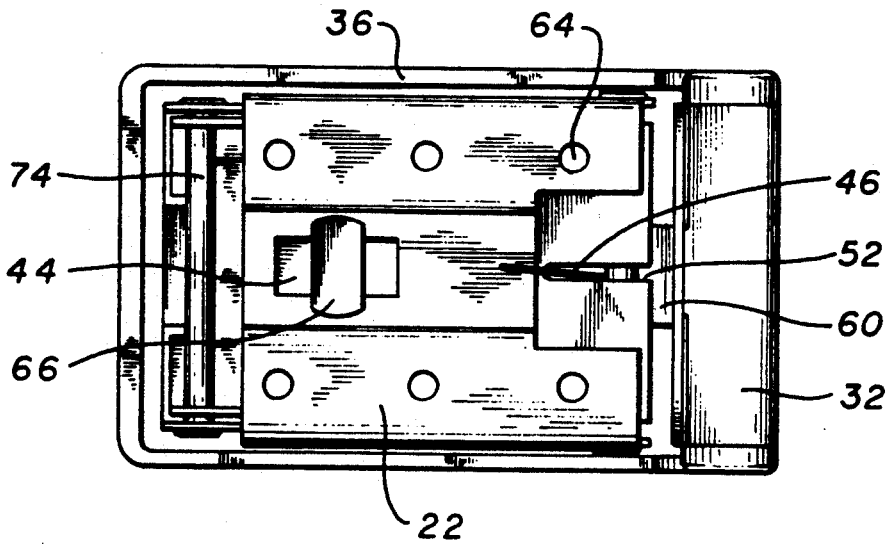
FIG. 8

FIG. 15
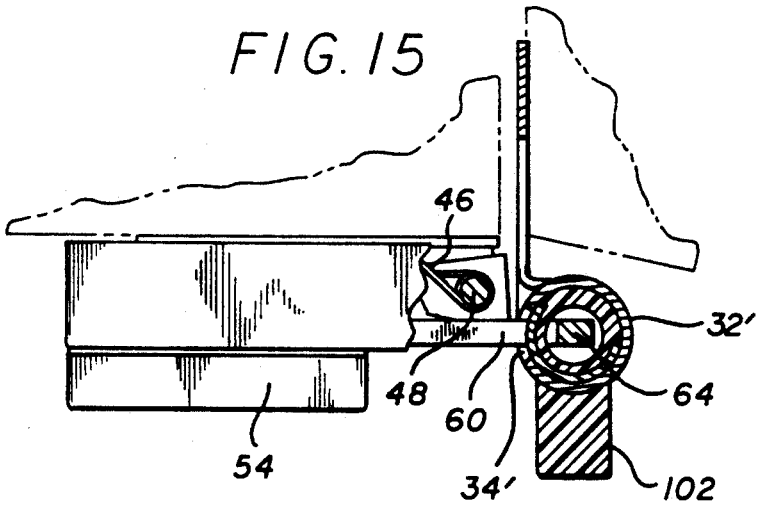
FIG. 10
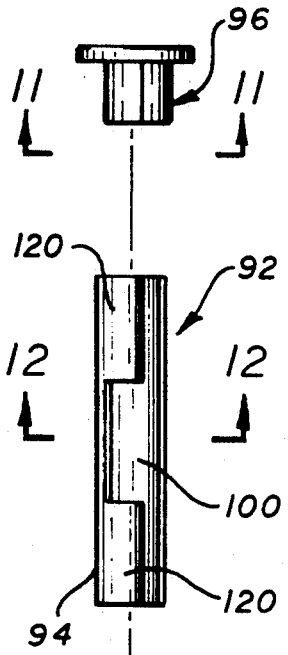
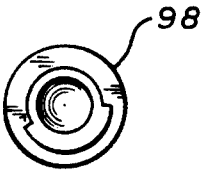
FIG. 14
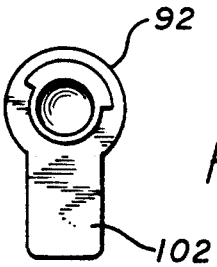
FIG. 11
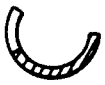
FIG. 12
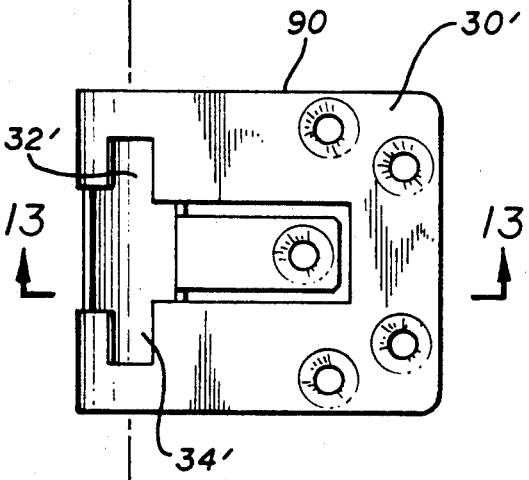
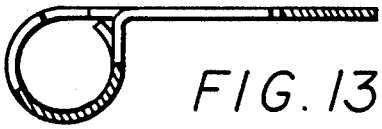
FIG. 13
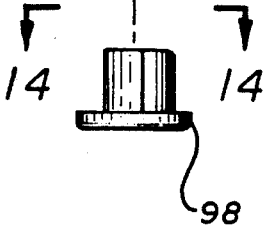
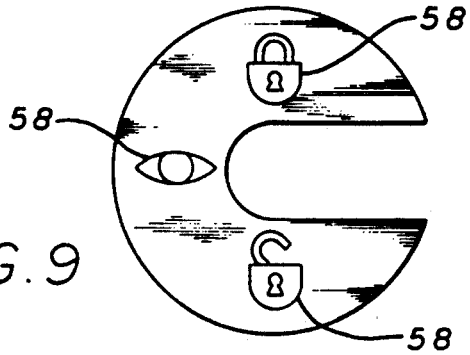
FIG. 9

Z-BAR SECURITY SYSTEM

INTRODUCTION

The present invention relates to door locks, and more particularly to a door lock that can: lock the door shut in dead bolt fashion; allow the door to open a limited distance; or allow the door to open freely.

BACKGROUND OF THE INVENTION

Many doors, such as household doors, are provided with a dead bolt lock in order to maintain security by bolting the door shut. Incidentally, dead bolts are normally required to extend one inch into the door frame and associated latch plate. Unfortunately, the dead bolt must be released and the door opened in order to (1) pass a small object through the doorway, such as an envelope or small package, or (2) to view the persons outside the door. While a short chain may be used to prevent the door from fully opening, such a chain arrangement is often weak.

An alternative to a standard dead bolt lock is a lock that can operate either in a mode similar to a dead bolt or as a latch having a "Z-Bar" configuration, which allows the door to open a limited distance. Such a lock is disclosed in U.S. Pat. No. 3,924,887. That device employs a baseplate which attaches to the door; an intermediate link; an outer link with a latch disk and a mode selection handle; and a latch plate mounted on the door frame into which the latch disk can latch.

However, there are at least four problems with the device. First, the device employs rounded "ears" to hold the latching assembly together in the dead bolt mode. As structural members, these "ears" are weak and can compromise the strength of the lock. Second, when the lock is in the dead bolt mode or limited-open mode, the latch disk can be pried out directly away from the latch, for instance by someone using a crowbar. Third, since the latch disk is the primary load-bearing portion of the lock, the latch disk should be as thick as possible. However, when the entire latch disk of U.S. Pat. No. 3,924,887 is made thick, the entire latch mechanism must increase in size to accommodate it.

Finally, the prior device does not provide for an indicator to inform the user what mode the lock is in. Without such an indicator, the user may unwittingly believe that the door has been dead bolted shut, when in fact it is unlocked or in the limited-open position.

It is also noted in passing that the related U.S. Pat. No. 3,924,886 discloses an alternative embodiment in FIGS. 7-10 of the patent, which only provides a sketchy and brief description, and does not have an intended dead bolt mode of operation.

SUMMARY OF THE INVENTION

It is desirable to provide a lock with the advantages of a "Z-Bar" latch but with the additional advantages of structural strength, resistance to prying, and user convenience. These goals are satisfied by the various embodiments of the present invention.

Generally stated, this invention relates to a "Z-Bar" door security system which provides three modes of operation. In the first mode, the system allows the door to open freely. In the second mode, the system permits the door to open a limited amount. In the third mode, the system locks the door to the door jamb with a dead bolt.

The present invention provides for a "Z-Bar" latch assembly, which includes a base plate that secures to the edge of a door. An intermediate link is pivoted to the base plate, and a mode selection and latching assembly is pivoted to the intermediate link. When the base plate, intermediate link, and mode selection and latching assembly are partially unfolded from one another, they form the shape of a "Z". The inventors have chosen to refer to their security system as a "Z-Bar" system.

The mode selection and latching assembly includes a control knob, which the user rotates to select the mode of operation. The mode selection and latching assembly also includes a high-strength latch member, which may be a thick steel bolt member, which slides back and forth as the control knob rotates. To complement the latch member, the invention has a latch plate that is mounted on the frame of a door opposite the base plate. There is a vertical slot in the latch plate for receiving the latch member.

The invention also has a structurally sound locking device extending from the control knob to secure together the baseplate, intermediate link, and mode selection and latching assembly when the latch is in the dead bolt mode of operation, and also, if desired, in the free-opening mode.

Two additional aspects of the invention achieve the goals of user convenience and resistance to prying. To achieve the goal of user convenience, one aspect of the present invention has an indicator on the mode selection and latching assembly to inform the user whether the lock is on the dead bolt, limited-open, or fully-open setting. To achieve the goal of resistance to prying, another aspect of the invention involves the provision of a special cylinder within the latch plate that the user can rotate to lock the latch inside of the latch plate.

In accordance with another feature of the invention the latch or bolt is shifted in position by camming arrangements intercoupling the control knob and the latch or bolt.

Other objects, features, and advantages of the invention will become apparent from a consideration of the following detailed description and from the accompanying drawings.

BRIEF DESCRIPTION OF THE DRAWING

FIG. 1 is a fragmentary perspective view of a door jamb and a door showing an embodiment of the "Z-Bar" security system;

FIG. 2 is a plan view of the latch plate shown in FIG. 1;

FIG. 3 is an end view of the latch plate;

FIG. 7 is a cross-sectional view of the "Z-Bar" latch assembly showing the mode selection and latching assembly and the intermediate link locked to the base plate;

FIG. 8 is a bottom view of the base plate showing the mode selection and latching assembly and the intermediate link latched to the base plate;

FIG. 9 is a top view of an indicator plate showing the mode selection indications;

Figure 4:
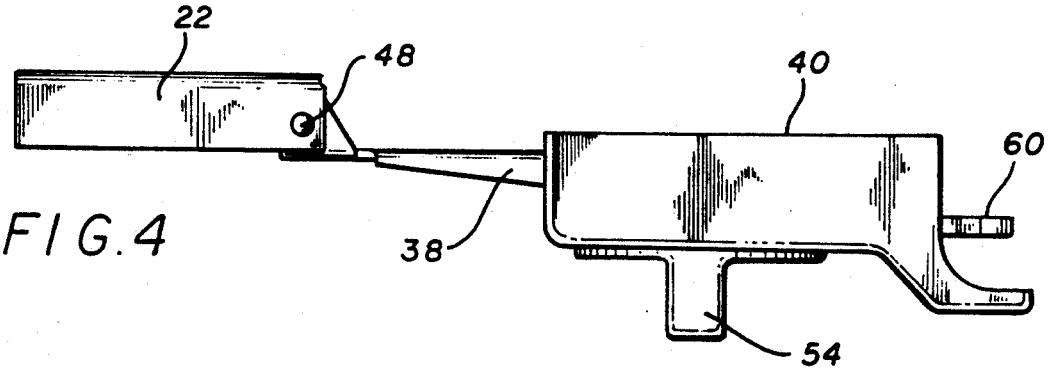
FIG. 4 is a side elevational view of the "Z-Bar" latch assembly shown in the fully extended position.
Figure 5:
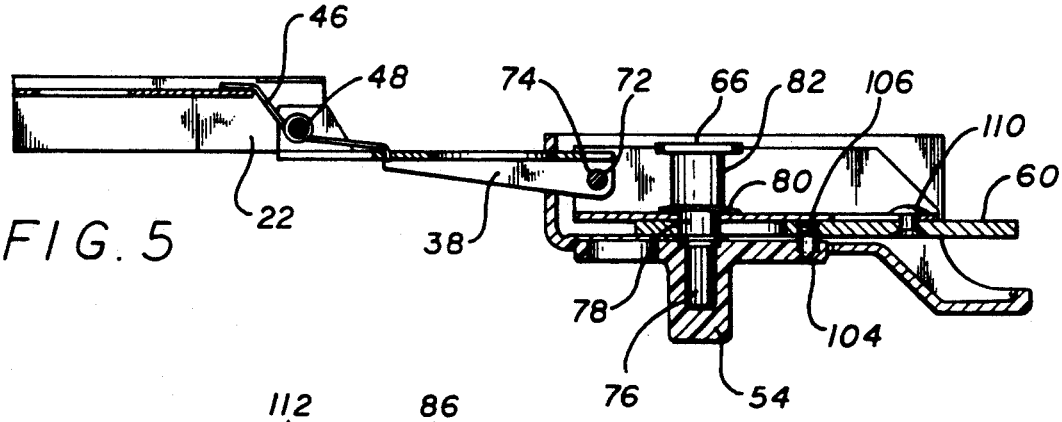
FIG. 5 is a length-wise sectional view of the "Z-Bar" latch assembly.

FIG. lo is an exploded side view of the latch plate and cylindrical sleeve showing a second embodiment of the invention;

FIG. 11 is a bottom view of the top cap and handle of the second embodiment, as seen from line 11 of FIG. 10;

FIG. 12 is a cross-section of the cylindrical sleeve taken along line 12 of FIG. 10;

FIG. 13 is a sectional view of the latch plate taken along line 13 of FIG. 10;

FIG. 14 is top view of the bottom cap taken along line 14 on FIG. 10; and

FIG. 15 is a top view of the second embodiment of the "Z-Bar" door security system shown in partial cross-section showing the system in the latched position and the dead bolt cylinder in the latch plate assembly rotated to the locked position.

DETAILED DESCRIPTION OF THE PREFERRED EMBODIMENT

This Description consists of three parts. The first part is a detailed definition of the components that make up the invention. The second part describes how the invention operates in each of its three modes: free-opening, inspection, and dead bolt. Finally, the third part describes a second embodiment of the invention that adds additional security.

I. Components of the Invention

The "Z-Bar" door security system is composed of four major components: the base plate, the intermediate link, the mode selection and latching assembly, and the latch plate.

a. The Base Plate

FIGS. 1 through 9 illustrate an embodiment 20 of the "Z-Bar" security system. FIG. 1 illustrates each of the four major components of the system, including the base plate.

Base plate 22 comprises base 42 which has suitable screwholes with screws 63 mounted therein for secure attachment of base 42 onto door 24. Base plate 22 has upturned flange edges 36. These flange edges have a pivot pin hole at the end of the base toward the door edge, and pivot pin 48 extends through this hole. A bias spring 46 is coiled around pivot pin 48 and bears at one end onto base 42. Base plate 22 further comprises an aperture 44, through which locking flange 66 (FIG. 5) can pass.

b. The Intermediate Link

Intermediate link 38 has at one end a pair of flanges 70 through which pivot pin 48 passes. Intermediate link 38 also has downturned, tapered flange edges 68. The narrow end of tapered flanges 68 begins near the flanges 70 and increases in width along the length of intermediate link 38. The wide end of each of the flanges includes an aperture 72 (FIG. 5) through which passes pivot pin 74.

c. The Mode Selection and Latching Assembly

Mode selection and latching assembly 40 has a control knob 54, which includes a mode indicator including a view window 56 and symbols 58 (FIG. 9). A central post has three parts of different diameters, including outer portion 76 (FIG. 5) embedded in control knob 54, portion 78, which passes through washer 80, and portion 82, at the end of which is flange 66.

Mode selection and latching assembly 40 also has a T-shaped latch bar 60, comprised of a long neck portion 62 and a relatively narrower crossbar 64 at the outer end thereof. Latch bar 60 is positioned in channel 116 (FIG. 7), along which the latch bar can slide. Opening or slot 84 (FIG. 6) in the long neck portion 62 of latch bar 60 allows control knob post 78 to pass through.

Figure 6:
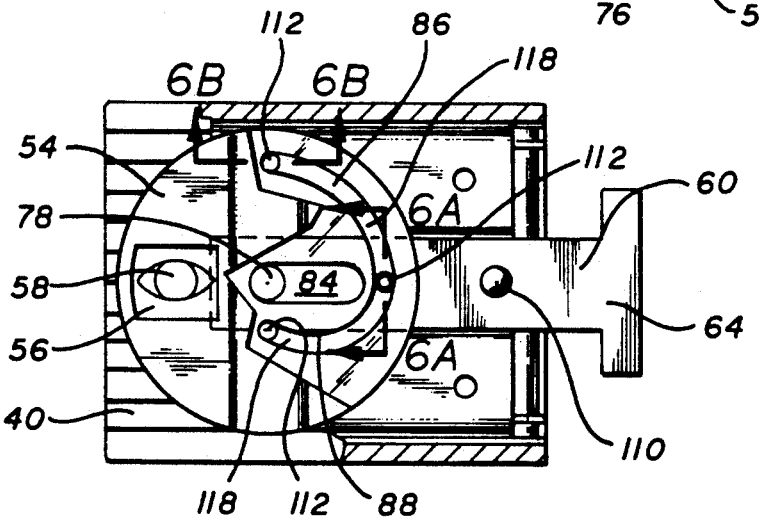
FIG. 6 is a plan view of the mode selection and latching assembly.
Figure 6B:
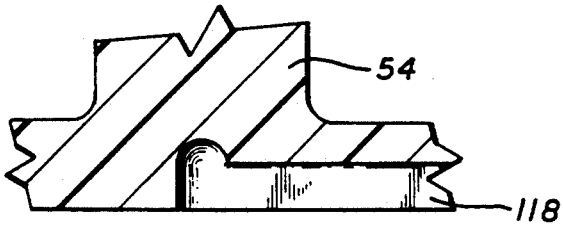
FIG. 6B is a sectional view of an inner surface of the control knob taken along line 6B of FIG. 6 showing a camming groove and groove indentation.
Figure 6A:
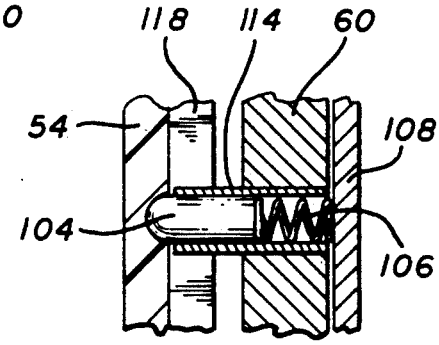
FIG. 6A is a sectional view of the control knob taken along line 6A oh FIG. 6 showing the latch pin in engagement with an indentation.

A portion of control knob 54 acts as a camming means which drives latch bar 60 along channel 116. Control knob 54 has a groove 113 consisting of groove segments 86 and 88. Groove 112 overlies an assembly consisting of pin 104, spring 106 and sleeve 114, as shown in FIGS. 6 and 6A. Sleeve 114 passes through latch bar 60. The bottom portion of spring 106 rests along the top of channel 116. Pin 104 is situated inside of sleeve 114 and is biased into groove 118 by spring 106. As control knob 54 rotates, pin 104 travels along groove 118. When pin 104 travels along groove segment 88, the contour of the groove pushes latch 60 either forward or backward, depending on the direction of rotation of the control knob. When pin 104 travels along groove segment 86, the contour of the groove does not affect the position of latch 60, and permits rotation of the knob and locking control flange 66 without shifting the position of the latch.

Groove 118 has indentations 112 that serve as stopping points or detents for pin 104. The location of each indentation 112 corresponds to the proper control knob position for the free-opening, inspection, and dead bolt modes of operation. When pin 104 reaches a groove indentation 112, spring 106 forces pin 104 into the indentation. The user must apply additional rotational force to dislodge pin 104 from the indentation 112 in which it is located.

d. The Latch Plate

Latch plate 30 comprises base 26 which has suitable screwholes in which screws 85 are mounted for secure attachment of base 26 onto door jamb 28. Latch plate 30 is rolled into a substantially cylindrical configuration 32 at one end. Base 26 has a "t"-shaped aperture 34 such that the lower portion of the "t" runs along the flat portion of the base, and the crossbar of the "t" crosses one edge of cylinder 32. The upper stem portion of the "t" follows a curved path along a portion of the surface of the cylinder. A tongue 86 extends from the edge of the cylinder to fill the lower portion of t-shaped aperture 34. Tongue 86 has at least one suitable screwhole 87 in which a screw is mounted for secure attachment of cylinder 32 and latch plate 30 to door jamb 28.

II. How the "Z-Bar" Door Security System Operates

The "Z-Bar" door security system operates in three modes. In the free-opening mode, the door is freely opened and shut without any interference from the system. In the inspection mode, the door can open only a limited distance. In the dead bolt mode, the system prevents the door from opening at all. The following is a detailed description of how the system operates in each mode.

a. Operation in the Free-Opening Mode

In the free-opening mode, base plate 22, intermediate link 38, and mode selection and latching assembly 40 lay flat against each other and are latched together, as in FIG. 7. Post 82 and flange 66 have passed through rectangular base plate aperture 44. Control knob 54 has been rotated into the free-swing position, thereby rotating flange 66 into the locked position, as in FIG. 8, with portions of flange 66 overlying the sides of rectangular opening 44. Rotation of control knob 54 has also put latch plate 60 in the retracted position, disengaged from latch plate 30, so that the security system does not prevent the door from swinging open freely.

b. Operation in the Inspection Mode

To position the security system in the inspection mode from the free-swing mode, the user rotates control knob 54 to disengage flange 66 from base plate aperture 44. Simultaneously, latch bar 60 extends to engage with latch plate 30 through aperture 34, by operation of cam section 88. As door 24 swings open, base plate 22 and intermediate link 38 unfold from the latched position in FIG. 7 to the extended position of FIGS. 4 and 5. Once base plate 22 and intermediate link 38 have fully extended, door 24 cannot swing open any further. Incidentally, the laterally extending portions of the crossbar 64 of the latch are held within the cylinder 32 of the latch plate, and the reduced width portion 62 of the latch swings up into the reduced width outer zone of the opening in the latch plate.

c. Operation in the Dead Bolt Mode

To put the security system in the dead bolt mode from the inspection mode, the user shuts the door so that bias spring 46 causes intermediate link 38 and mode selection and latching assembly 40 to fold together over base plate 22. The user then rotates control knob 54 to the dead bolt position, such that flange 66 is positioned perpendicular to the length of base plate aperture 44. The shape of groove 118 is such that latch 60 does not retract as the user rotates control knob 54 from the inspection mode position to the dead bolt mode position. With the "Z-Bar" latch assembly folded and locked together, and with latch 60 engaged with latch plate 30, the security system acts as a dead bolt, preventing the door from opening.

III. Second Embodiment of the Latch Plate

FIGS. 10 through 15 illustrate a second embodiment 90 of the latch plate system of the "Z-Bar" security system. In this embodiment of the invention, a latch-securing mechanism 92 is inserted into latch plate cylinder 32' for the purpose of securing the latch within the cylinder. Latch-securing mechanism 92 comprises tube 94, top cap 96, and bottom cap 98.

Tube 94 fits inside latch plate cylinder 32', as indicated by FIG. 10. Tube 94 has a T-shaped aperture 100 through which latch 60 passes after entering latch plate 30'. Top cap 96 fits over the top of tube 94. FIG. 11 shows handle 102, secured to top cap 96, that the user can turn to rotate tube 94. Bottom cap 98 is secured to the bottom of tube 94 and serves to mount and maintain tube 94 within latch plate cylinder 32'. Unlike top cap 96, bottom cap 98 does not have a handle, as illustrated in FIG. 14.

FIG. 15 illustrates how the latch-securing mechanism operates. Latch 60 enters latch plate 30' at aperture 34' (FIG. 10), then passes through aperture 100 of tube 94. The user turns handle 102 of top cap 96, thereby rotating tube 94, and securing the ends of cross-piece 64 of the latch member behind the portions 120 of the rotated sleeve 92. The crossbar of latch 60 is held within latch plate cylinder 32', and cannot be pried out of latch plate 30' until the user turns handle 102 back to its original position.

Concerning dimensions, it is desirable that the bolt or latch member be of considerable strength, and it is preferably made of steel, at least ⅛ inch thick, and preferably 3/16 inch thick. It is 1¼ inch wide at the end, about ⅝ inch wide along its length, and about three inches long. These dimensions are given by way of example and not of limitation.

With the rotating cylinder actuated in the latch plate assembly to the locked position, the security is equal to and probably greater than that provided by conventional dead bolts, as the bolt or latch member of the present invention cannot be directly withdrawn from the latch plate.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, the supplemental locking arrangements in the latch plate may be implemented by a sliding member instead of a rotating cylinder, and the locking end of the latch member may be bifurcated with inwardly directed end portions instead of outwardly projected end portions. In addition, instead of a locking member 66 on the control knob shaft, the three portions of the Z-Bar assembly may be locked together by a separate mechanical locking mechanism. Accordingly, the present invention is not limited to the specific embodiments shown in the drawings and described in the detailed description.

We claim:

1. A Z-Bar door security system providing (1) entry, (2) inspection, and (3) dead bolt modes of operation, comprising:

a latch plate for mounting on the frame of the door, said latch plate having a vertical slot for receiving a latch bar;

a Z-Bar latch assembly including (1) a base plate for securing to the edge of the door in juxtaposition to said latch plate, (2) an intermediate link pivoted to said base plate at the front edge of said base plate adjacent the door, and (3) a mode selection and latching assembly pivotally mounted to said intermediate link at the front edge of said intermediate link;

said mode selection and latching assembly including a rotatably mounted control knob and a high strength latch member, and camming means for linearly advancing said latch member into engagement with said slot in said latch plate as said control knob is rotated, to implement the inspection and the dead bolt modes of operation;

means secured to said control knob for securing the base plate, the intermediate link and the mode selection and latching assembly together while the latch member is extended into engagement with the latch plate, thereby providing the dead bolt mode of operation; and said camming means including camming surfaces permitting further rotation of said control knob without retracting the latch member to implement the dead bolt mode of operation.

2. The Z-Bar door security system as defined in claim 1 wherein said high strength latch member is "T"-shaped, with a crossbar portion at the outer end thereof.

3. The Z-Bar door security system as defined in claim 1 wherein said latch plate includes a cylindrical tube having said vertical slot for receiving the outer end of said latch member.

4. The Z-Bar door security system as defined in claim 1 further comprising spring means associated with said base plate and said intermediate link for biasing said intermediate link to lay flat on top of said base plate.

5. The Z-Bar door security system as defined in claim 1 wherein said mode selection and latching assembly has a top panel having a channel along which said latch member slides.

6. The Z-Bar door security system as defined in claim wherein a lock pin interconnects said base, said intermediate link and said mode selection and latching assembly while the latch member is extended into engagement with the latch plate, said lock pin comprising a cylindrical shaft with a transversely extending head.

7. The Z-Bar door security system as defined in claim 2, further comprising means to secure the "T"-shaped latch member into engagement with said latch plate, said means comprising a cylindrical sleeve having a "T"-shaped opening, said cylinder being positioned inside of the cylindrical tube of the latchplate, with a handle affixed to one end of said cylindrical sleeve for rotating said sleeve to engage the "T"-shaped latch member.

8. The Z-Bar door security system as defined in claim 1, wherein said mode selection and latching assembly includes a mode indicator to display whether the door is deadlocked shut, allowed to open a limited distance, or allowed to open freely.

9. A Z-Bar security system as defined in claim 1 wherein supplemental movable locking means are mounted to said latch plate for positively locking said latch member to said latch plate.

10. A Z-Bar door security system providing (1) entry, (2) inspection, and (3) dead bolt modes of operation, comprising:

a latch plate for mounting on the frame of a door, said latch plate having a slot for receiving a latch bar;

a Z-Bar latch assembly including (1) a base plate for securing to the edge of the door in juxtaposition to said latch plate, (2) an intermediate link pivoted to said base plate, and (3) a mode selection and latching assembly pivotally mounted to said intermediate link;

said mode selection and latching assembly including a latch member, and means for linearly advancing said latch member into engagement with said latch plate; and means for locking said base plate, said intermediate link and said latching assembly together without retracting the latch, to implement the dead bolt mode of operation.

11. The Z-Bar door security system as defined in claim 10 wherein said latch member is "T"-shaped.

12. The Z-Bar door security system as defined in claim 10 wherein said latch plate includes a cylindrical tube having said vertical slot for receiving a latch bar.

13. The Z-Bar door security system as defined in claim 10 further comprising spring means associated with said base plate and said intermediate link for biasing said intermediate link to lay flat on top of said base plate.

14. The Z-Bar door security system as defined in claim 10 wherein said mode selection and latching assembly has a top panel having a channel along which said latch member slides.

15. The Z-Bar door security system as defined in claim 10 wherein a lock pin interconnects said base, said intermediate link and said mode selection and latching assembly while the latch is extended into engagement with the latch plate, said lock pin comprising a cylindrical shaft with a transversely extending head.

16. The Z-Bar door security system as defined in claim 10, wherein said mode selection and latching assembly includes a mode indicator to display whether the door is deadlocked shut, allowed to open a limited distance, or allowed to open freely.

17. The Z-Bar door security system as defined in claim 11, further comprising means to secure the "T"-shaped latch member into engagement with said latch plate, said means comprising a cylindrical sleeve having a "T"-shaped opening, said cylinder being positioned inside of said cylindrical tube of the latchplate, with a handle affixed to ne end of said cylindrical sleeve for rotating said sleeve to engage the "T"-shaped latch member.

18. A system for pivotally securing a latch to a latch plate mounted on a door frame, said system, comprising:

a latch member;

a latch plate comprising a cylindrical tube having a slot for receiving said latch member;

a cylindrical sleeve having an aperture, said cylindrical sleeve being positioned inside of said cylindrical tube of said latch plate;

a handle affixed to one end of said cylindrical sleeve for rotating said sleeve to engage said latch member inside said cylindrical sleeve; and said system including means for permitting partial opening of the door with said latch member secured within said latch plate.

19. The system for pivotally securing a latch to a latch plate mounted on a door frame of claim 18, in which said latch member is "T"-shaped and comprises a "neck" portion and a "crossbar" portion.

20. A system to secure a latch member of a Z-Bar door latch system to a latch plate, wherein the Z-Bar door latch system provided (1) entry, (2) inspection, and (3) dead bolt modes of operation, the system to secure the latch member comprising:

a latch member;

a latch plate comprising a cylindrical tube having a slot for receiving said latch member;

a cylindrical sleeve having an aperture, said cylindrical sleeve being positioned inside of said cylindrical tube of said latch plate;

a handle affixed to one end of said cylindrical sleeve for rotating said sleeve to engage said latch member inside said cylindrical sleeve;

a Z-bar latch assembly including (1) a base plate for securing to the edge of a door in juxtaposition to said latch plate, (2) an intermediate link pivoted to said base plate at the front edge of said base plate adjacent the door, and (3) a mode selection and latching assembly pivotally mounted to said intermediate link at the front edge of said intermediate link;

said mode selection and latching assembly including a rotatably mounted control knob and said latch member, and camming means for linearly advancing said latch member into engagement with said slot in said latch plate as said control knob is rotated;

means secured to said control knob for securing the base plate, the intermediate link and the mode selection and latching assembly together while the latch is extended into engagement with the latch plate, thereby providing the dead bolt mode of operation; and said camming means, including camming surfaces permitting further rotation of said control knob without retracting the latch to implement the head bolt mode of operation.

21. A system to secure a latch member into engagement with a latch plate, comprising:

a latch member;

a latch plate comprising a cylindrical tube having a slot for receiving said latch member;

a cylindrical sleeve having an aperture, said cylindrical sleeve being positioned inside of said cylindrical tube of said latch plate;

a handle affixed to one end of said cylindrical sleeve for rotating said sleeve to engage said latch member inside said cylindrical sleeve;

in which said latch member is "T"-shaped and comprises a "neck" portion and a "crossbar" portion; and in which said aperture in said cylindrical sleeve is "T"-shaped, comprising a "neck" portion and a "crossbar" portion, such that said "neck" portion of said "T"-shaped aperture is wide enough to accommodate said "neck" portion of said "T"-shaped latch member.

* * * * *